US012329243B2

(12) United States Patent
Itskowitz

(10) Patent No.: US 12,329,243 B2
(45) **Date of Patent: *Jun. 17, 2025**

(54) RESTRAINING DEVICE TO INHIBIT REMOVAL OF FOOTWEAR

(71) Applicant: Darren Itskowitz, Simi Valley, CA (US)

(72) Inventor: Darren Itskowitz, Simi Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/121,148

(22) Filed: Mar. 14, 2023

(65) Prior Publication Data

US 2023/0218044 A1 Jul. 13, 2023

Related U.S. Application Data

(63) Continuation of application No. 17/517,161, filed on Nov. 2, 2021, now Pat. No. 11,602,199.

(51) Int. Cl.

| | |
|---|---|
| ***A43C 11/14*** | (2006.01) |
| ***A43C 1/04*** | (2006.01) |
| ***A43C 11/00*** | (2006.01) |

(52) U.S. Cl.

CPC ..... *A43C 11/14* (2013.01); *A43C 1/04* (2013.01); *A43C 11/008* (2013.01)

(58) Field of Classification Search

None

See application file for complete search history.

(56) References Cited

U.S. PATENT DOCUMENTS

| | | | | |
|---|---|---|---|---|
| 1,229,913 | A | 6/1917 | Donisthrope et al. | |
| 4,852,223 | A * | 8/1989 | McCreary | F16G 11/101 24/712.7 |
| 5,649,342 | A * | 7/1997 | D'Andrade | A43C 7/005 24/712.2 |
| 7,591,050 | B2 | 9/2009 | Hammerslag | |
| 8,468,657 | B2 * | 6/2013 | Soderberg | A43C 11/165 242/395 |
| 8,490,299 | B2 | 7/2013 | Dua et al. | |
| 9,282,783 | B2 | 3/2016 | Roser | |
| 10,182,617 | B2 | 1/2019 | Craig | |
| 10,264,854 | B2 | 4/2019 | Greene et al. | |
| 10,758,008 | B2 * | 9/2020 | Aihara | A45C 13/1069 |

(Continued)

FOREIGN PATENT DOCUMENTS

EP 0307379 A2 3/1989

*Primary Examiner* — Jila M Mohandesi

(74) *Attorney, Agent, or Firm* — Trojan Law Offices

(57) ABSTRACT

A restraining device configured to inhibit the removal of an article of footwear to which the restraining device is attached is provided. The restraining device will prevent footwear from being removed regardless of the type of fastening means used to secure the footwear to the foot of a wearer and whether the fastening means are fastened. In some embodiments, the restraining device is configured to be permanently attached to an article of footwear. In other embodiments, the restraining device is configured to be removably attached to an article of footwear. In some embodiments, the restraining device generally includes a ring-shaped member, a tightening means, and a locking mechanism. In other embodiments, the restraining device generally includes a restraining strap and a unique locking mechanism.

4 Claims, 9 Drawing Sheets

(56) References Cited

U.S. PATENT DOCUMENTS

| | | | | |
|---|---|---|---|---|
| 10,849,389 | B1 * | 12/2020 | Darrow | A47G 25/80 |
| 11,602,199 | B2 * | 3/2023 | Itskowitz | A43B 3/30 |
| 2002/0020046 | A1 | 2/2002 | Voughlohn | |
| 2009/0000150 | A1 * | 1/2009 | Wong | A43B 5/06 36/89 |
| 2012/0291242 | A1 * | 11/2012 | Donnadieu | A43C 11/20 24/712.7 |
| 2015/0027479 | A1 * | 1/2015 | Lei | A45D 8/34 132/273 |
| 2015/0305432 | A1 | 10/2015 | Wiens | |
| 2018/0110295 | A1 * | 4/2018 | Dyer | A43C 1/06 |
| 2022/0142302 | A1 * | 5/2022 | Itskowitz | A43C 11/008 |

* cited by examiner

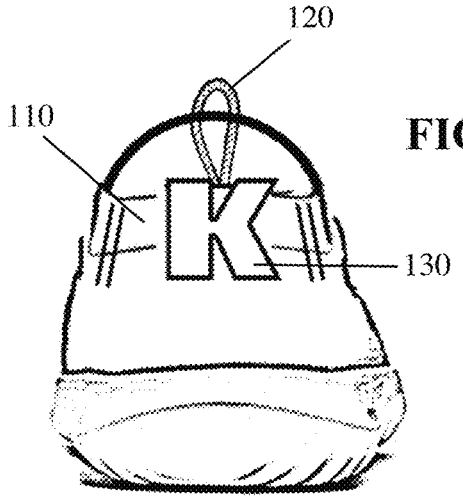
FIG. 3
FIG. 4
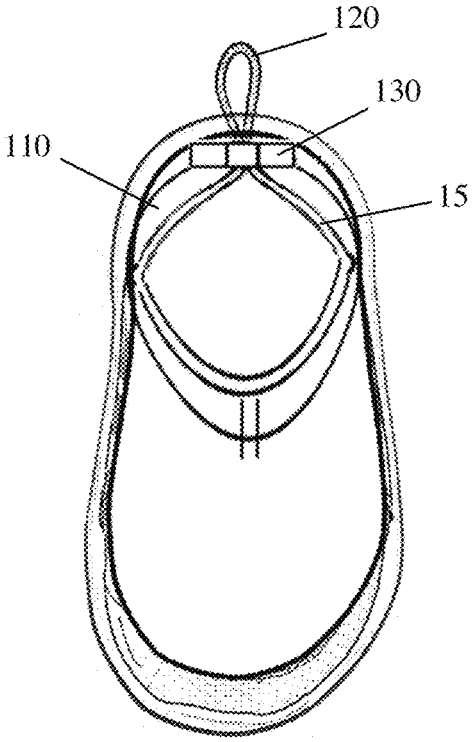
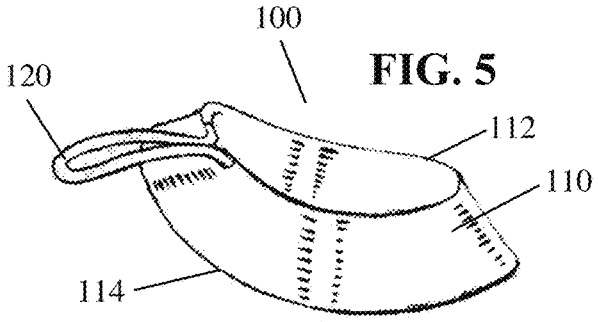
FIG. 5
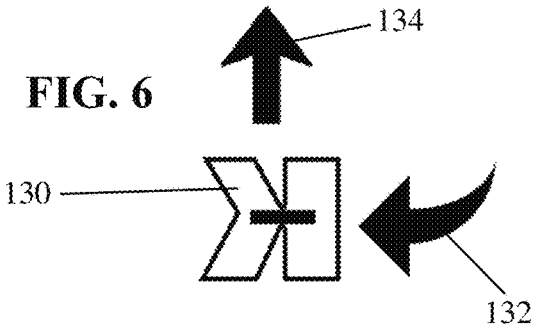
FIG. 6
FIG. 7
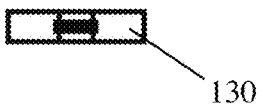

RESTRAINING DEVICE TO INHIBIT REMOVAL OF FOOTWEAR

CROSS RELATED APPLICATIONS

This application is a continuation of U.S. application Ser. No. 17/517,161, filed Nov. 2, 2021, which claims priority to U.S. provisional application No. 63/110,907 filed Nov. 6, 2020, both of which are incorporated by reference herein in their entirety.

FIELD OF THE INVENTION

The present invention relates generally to a restraining device configured to inhibit the removal of footwear from a wearer of the footwear.

BACKGROUND OF THE INVENTION

Footwear is used for many purposes, including but not limited to protection, comfort, and fashion. Generally, footwear is secured to the foot of a wearer by shoelaces or hook-and-loop type systems. The shoelaces, hook-and-loop straps, or similar systems for securing the footwear to the foot of a wearer are configured to tighten the footwear to the foot of a wearer, thus preventing removal when the system is secured.

One problem with these systems of securing footwear to the foot of a wearer is that while they are easily secured, they are also easily loosened and removed. While this is desirable for some wearers of footwear, others, such as small children or adults with special needs, often remove their footwear at inopportune or inappropriate times in spite of the fact that they are fastened in place. These wearers know how to loosen the general systems for securing footwear, and thus are capable of removing the footwear at their liking. Thus, there is a need for a device configured to inhibit the removal of footwear by preventing the release of the footwear from the foot of a wearer, regardless of whether the footwear is fastened to the foot of a wearer.

SUMMARY OF THE INVENTION

A restraining device configured to prevent footwear from being removed from the foot of a wearer is provided. The restraining device will prevent footwear from being removed regardless of the type of fastening means used to secure the footwear to the foot of a wearer and whether the fastening means are fastened. Generally, the restraining device includes a ring-shaped member, a tightening means, and a locking mechanism. In some embodiments, the restraining device is configured to be permanently attached to an article of footwear. In other embodiments, the restraining device is configured to be removably attached to an article of footwear.

A first embodiment of the restraining device generally includes a ring-shaped member, a pull-string, and a locking mechanism. This embodiment may be permanently or removably attached to an article of footwear. In this embodiment, the pull-string is configured to be inserted into the top portion of the ring-shaped member, such that pulling the pull-string tightens the top portion of the ring-shaped member around the leg/ankle/foot of the wearer. Once the ring-shape member is tightened, the locking mechanism locks the pull-string in place, thereby inhibiting the removal of the article of footwear from the wearer, regardless of whether the footwear is tight or loose on the wearer's foot.

A second embodiment of the restraining device generally includes a ring-shaped member, tightening means, and a locking mechanism. This embodiment may also be permanently or removably attached to an article of footwear. In this embodiment, the tightening means and optionally the locking mechanism are configured to be hidden beneath or as part of the ring-shaped member, such that tightening means and locking mechanism are hidden from view of the footwear while in use.

A third embodiment of the restraining device generally includes a restraining strap, a locking mechanism, and optionally a comfort pad. This embodiment may be permanently or removably attached to an article of footwear. In this embodiment, the restraining strap is configured to surround the leg/ankle/foot of the wearer. Once the restraining strap is tightened, the locking mechanism locks the restraining strap in place, thereby inhibiting the removal of the article of footwear from the wearer, regardless of whether the footwear's fastening means is fastened or not. The fourth embodiment of the restraining device utilizes a similar configuration as the third embodiment, but instead uses a different location for the locking mechanism when secured to the footwear.

A unique locking mechanism depicted in the third and fourth embodiments of the restraining device is also provided. This locking mechanism generally includes a strap insert and exit slot, a flexible retainer, a pair of pins, a pin holder for each pin, a push mechanism, and a locking plate. The interaction of these components in combination with the restraining strap creates a secure restraining device for inhibiting the removal of the footwear to which the restraining device is attached.

While these four exemplary embodiments are depicted for purposes of understanding the invention and concepts disclosed herein, other embodiments utilizing the same concepts are further contemplated.

BRIEF DESCRIPTION OF THE DRAWINGS

These and other features and advantages of the present invention will become appreciated, as the same becomes better understood with reference to the specification, claims and drawings herein:

FIG. 3 is a rear view of the restraining device of FIG. 1 secured to footwear.

FIG. 4 is a top view of the restraining device of FIG. 1 secured to footwear.

FIG. 5 is a perspective view of the restraining device of FIG. 1.

FIG. 6 is a rear view of a locking mechanism of the restraining device of FIG. 1.

FIG. 7 is a top view of the locking mechanism of FIG. 6.

DETAILED DESCRIPTION OF THE INVENTION

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present there between. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

As used herein, the singular forms "a," "an," and "the," are intended to include the plural forms as well, unless the context clearly indicates otherwise. It will be further understood that the terms "comprises" and/or "comprising," "includes" and/or "including," and "have" and/or "having," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," and "upper" or "top," and "inner" or "outer," may be used herein to describe one element's relationship to another elements as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 13:
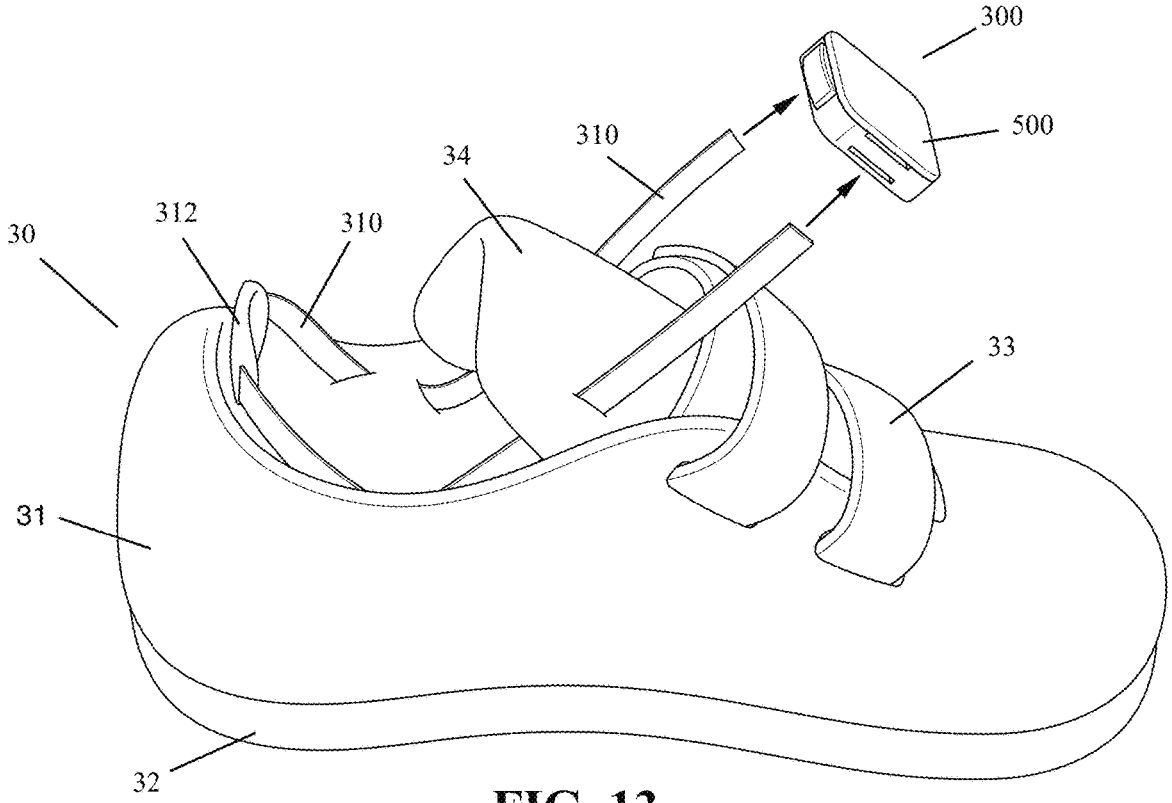
FIG. 13 is a side perspective view of a third embodiment of a restraining device for inhibiting the removal of footwear in an unlocked configuration.
Figure 14:
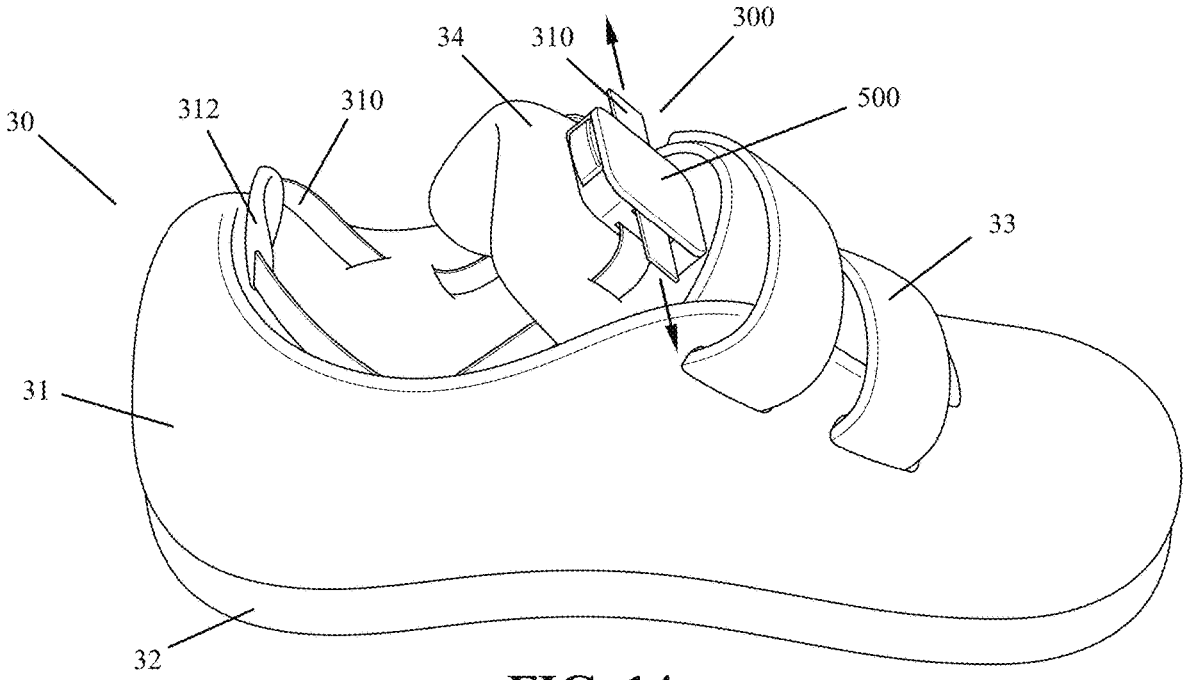
FIG. 14 is a side perspective view of the restraining device of FIG. 13 in a locked configuration.

A restraining device configured to prevent footwear from being removed from the foot of a wearer is provided. The restraining device will prevent footwear from being removed regardless of the type of fastening means used to secure the footwear to the foot of a wearer and whether the fastening means are fastened. FIGS. 1-7 provide a first embodiment of the invention and concepts disclosed. FIGS. 8-12 provide a second embodiment of the invention and concepts disclosed. FIGS. 13-14 provide a third embodiment of the invention and concepts disclosed. FIGS. 15-22 provide a fourth embodiment of the invention and concepts disclosed herein, having the same locking mechanism as the third embodiment. While these four exemplary embodiments are depicted for purposes of understanding the invention and concepts disclosed herein, other embodiments utilizing the same concepts are further contemplated.

FIGS. 1-7 depict the first embodiment of the restraining device 100. FIGS. 1-4 show the restraining device 100 attached to an article of footwear 10. The footwear 10 has an upper 11, a lower 12, a fastening means 13, a tongue 14, and a collar 15. For purposes of this disclosure, lower is defined as the sole of the footwear, and upper is defined as the portion of the body of the footwear that houses the foot and includes the foot opening of the footwear. While footwear 10 having these elements is utilized in connection with the first embodiment, any type of footwear 10 may be utilized with the restraining device 100 without departing from the concepts disclosed herein. Generally for all footwear, when a wearer inserts their foot into the footwear 10, the wearer's foot is inserted through the collar 15 and is enclosed by the tongue 14, upper 11, and lower 12. The fastening means 13 fasten the footwear 10 to the wearer's foot, such that while the fastening means 13 are secured, the footwear 10 remains secured around the wearer's foot. Typically, the fastening means 13 are easily fastened or loosened such that the wearer can easily put on or take off the footwear 10 at their liking. For example, footwear 10 uses fastening means 13 such as shoelaces or hook-and-loop fasteners that are easily secured but similarly easily removed.

While removing footwear 10 at a wearer's leisure is acceptable for most wearers, this is not the case for others, such as children and/or adults with special needs. The restraining device 100 is configured to secure the footwear 10 on these other wearers such that the footwear 10 cannot be removed by simply loosening the fastening means 13.

In the first embodiment, the restraining device 100 has a ring-shaped member 110, a pull-string 120, and a locking mechanism 130. The restraining device 100 is placed around the collar 15 and on top of the tongue 14 of the footwear 10. The ring-shaped member 110 of the restraining device 100 has a top portion 112 and a bottom portion 114, defined by the location of each portion when positioned on the footwear 10. For illustrative purposes, if the ring-shaped member 110 was placed flat, the top portion 112 is the component defining the inner circle of the ring-shaped member 110, and the bottom portion 114 is the component defining the outer circle of the ring-shaped member 110. The ring-shaped member 110 may be made of any flexible material.

FIG. 5 shows the restraining device 100 not secured to footwear 10 and without the locking mechanism 130. As shown in FIG. 5, the top portion 112 of the ring-shaped member 110 has a pull-string 120 placed throughout the top portion 112. A portion of the pull-string 120 extrudes from the top portion 112 of the ring-shaped member 110 such that the pull-string can be pulled, thereby reducing the diameter of the inner circle of the ring-shaped member 110. The lower portion 114 of the ring-shaped member 110 is configured to attach to the article of footwear 10.

The restraining device 100 may be removably attached or permanently attached to the footwear 10. For example, the lower portion 114 may be permanently sewn or glued to the upper 11 of the footwear 10, or alternatively may be removably adhered to the upper 11. While the exemplary embodiments show the lower portion 114 attached to the upper 11 of the footwear 10, other embodiments may be configured so the lower portion 114 is capable of being attached to other pieces of the footwear 10, such as the lower 12, fastening means 13, and/or the tongue 14. Any attachment means providing the permanent or removable attachment of the restraining device 100 to the footwear 10 may be utilized without departing from the concepts disclosed herein.

As shown in FIGS. 1-4, once the lower portion 114 of the ring-shaped member 110 is attached to the footwear 10, the upper portion 112 of the ring-shaped member 110 sits near or above the collar 15 of the footwear 10. Once a wearer's foot is inserted through the collar 15 and into the footwear 10, the wearer's foot, ankle, or lower leg will be surrounded and covered by the top portion 112 of the ring-shaped member 110. The wearer then pulls the pull-string 120 to tighten the top portion 112 of the ring-shaped member 110 around the wearer's foot/ankle/lower leg. The pull-string 120 is then locked into place by the locking mechanism 130.

This system keeps the footwear 10 on the wearer's foot regardless of whether the fastening means 13 of the footwear 10 is fastened, as the restraining device 100 is tightened around the wearer's foot/ankle/lower leg. Importantly, the portion of the wearer's leg located below the top portion 112 of the restraining device 100 must be larger than the central opening of the ring-shaped member 110 when the top portion 112 is tightened via the pull-string 120. Thus, even if the fastening means 13 of the footwear 10 is loosened, the wearer cannot remove the footwear 10 from their foot, as the size of the wearer's leg beneath the top portion 112 of the restraining device 100 is larger than the opening of the restraining device 100. The restraining device 100 is particularly effective if the top portion 112 of the restraining device 100 is placed above the wearer's ankle, as the wearer's ankle will provide additional area that cannot be removed from the opening of the restraining device 100 absent loosening the pull-string 120. The restraining device 100, once tightened, will also inhibit the removal of the footwear 10 when the footwear 10 is under external forces. For example, the restraining device 100 will inhibit the removal of the footwear 10 if a wearer were to try to kick off the footwear 10 or use their hands to pull off the footwear 10.

FIGS. 6-7 depicts a first exemplary embodiment of the locking mechanism 130 of the restraining device 100. In this exemplary embodiment, the locking mechanism 130 is a "k-lock". This locking mechanism 130 is configured to accept the pull-string 120 and lock the pull-string 120 in place. In this exemplary embodiment, the pull-string 120 is inserted through the pull-string insert 132 and exits through the pull-string exit 134. Once inserted, the sideways v portion of the "k-lock" locks the pull-string 120 in place, thus locking the restraining device 100 in place. Once the pull-string 120 is locked into place via the locking mechanism 130, the restraining device 100 effectively inhibits the removal of the footwear 10, regardless of whether the fastening means 13 of the footwear 10 are fastened or not. While a "k-lock" is presented in this exemplary embodiment shown in FIGS. 1-7, any other locking mechanisms may be similarly utilized without departing from the concepts disclosed herein, such as the locking mechanism 500 depicted in FIGS. 13-22.

Figure 1:
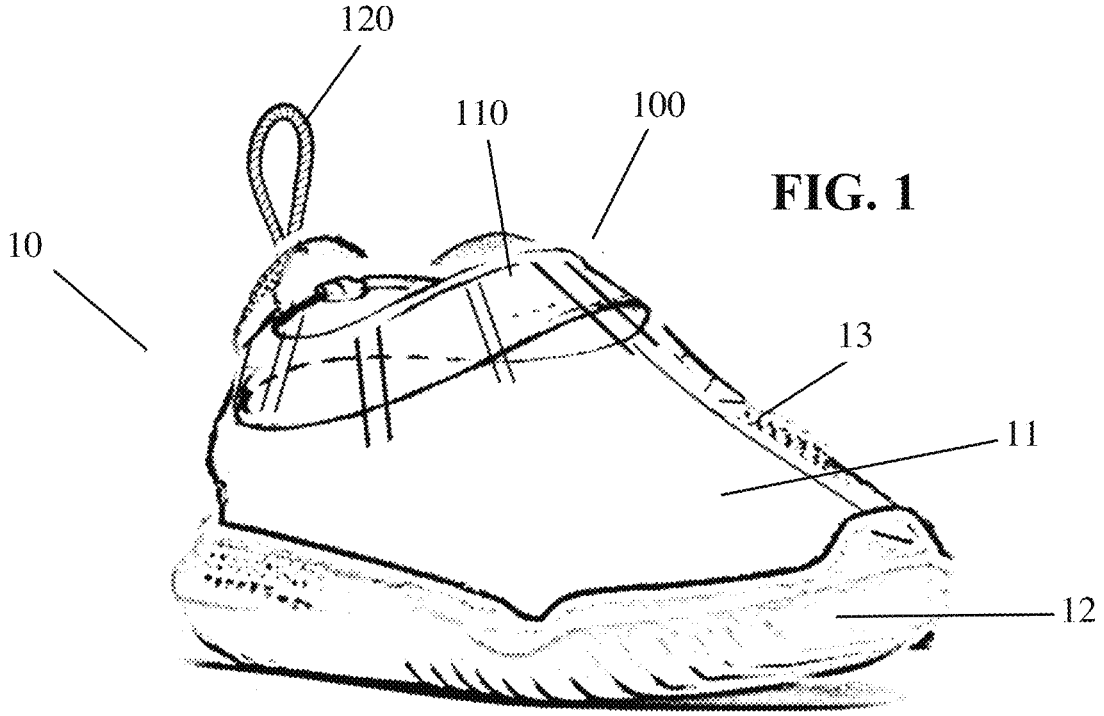
FIG. 1 is a front perspective view of a first embodiment of a restraining device for inhibiting the removal of footwear secured to footwear.
Figure 2:
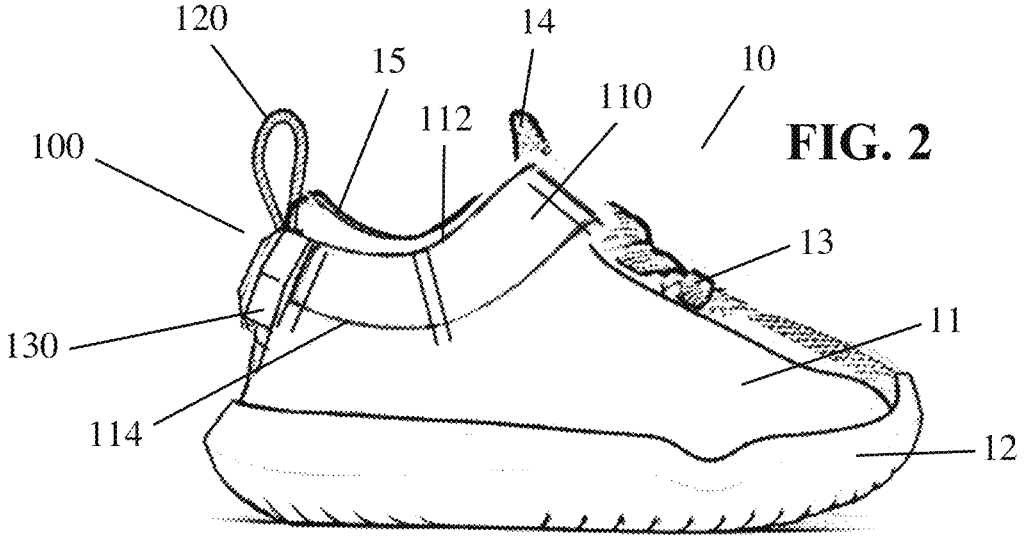
FIG. 2 is a side view of the restraining device of FIG. 1 secured to footwear.
Figure 8:
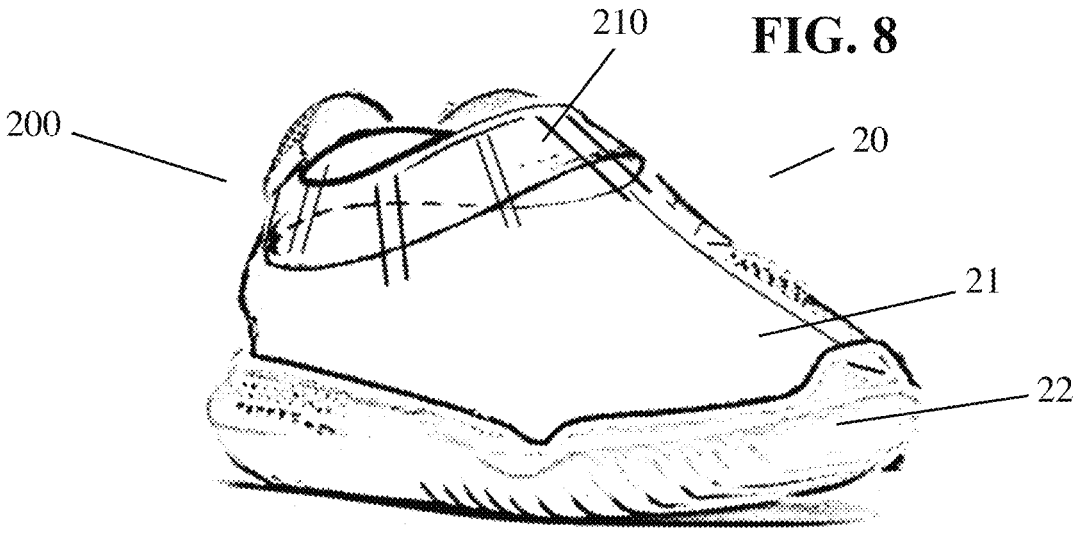
FIG. 8 is a perspective view of a second embodiment of a restraining device for inhibiting the removal of footwear secured to footwear.
Figure 9:
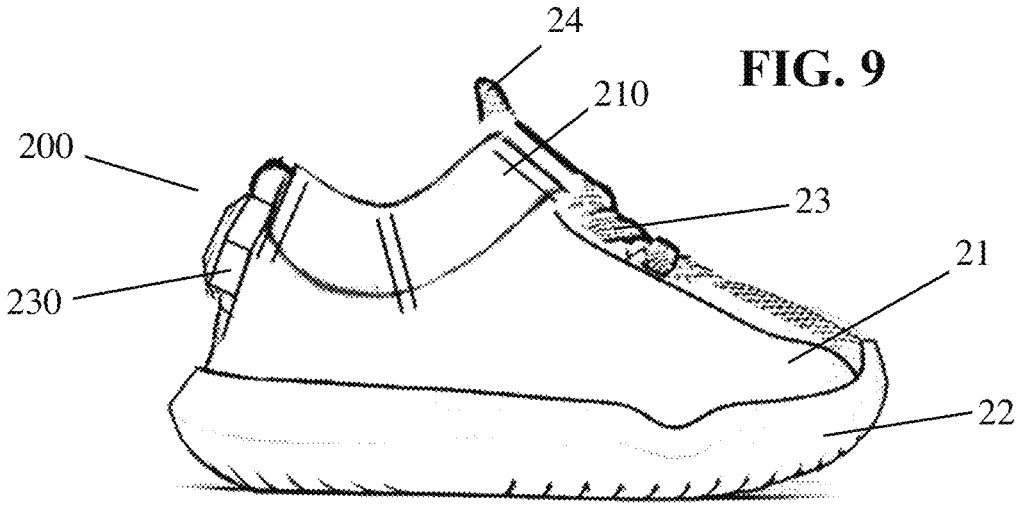
FIG. 9 is a side view of the restraining device of FIG. 8 secured to footwear.
Figure 10:
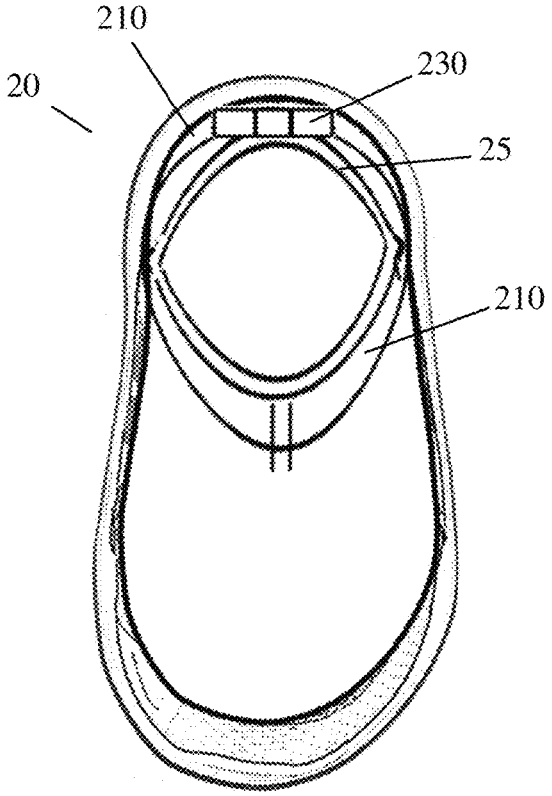
FIG. 10 is a top view of the restraining device of FIG. 8 secured to footwear.
Figure 11:
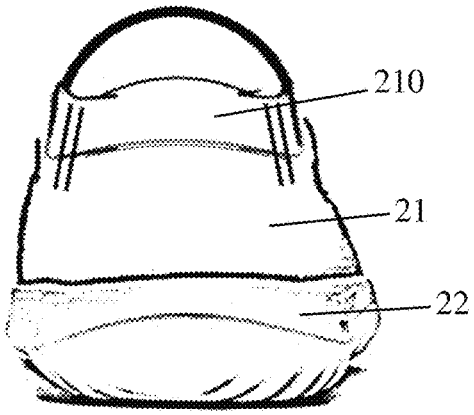
FIG. 11 is a rear view of the restraining device of FIG. 8 secured to footwear having a hidden locking mechanism.
Figure 12:
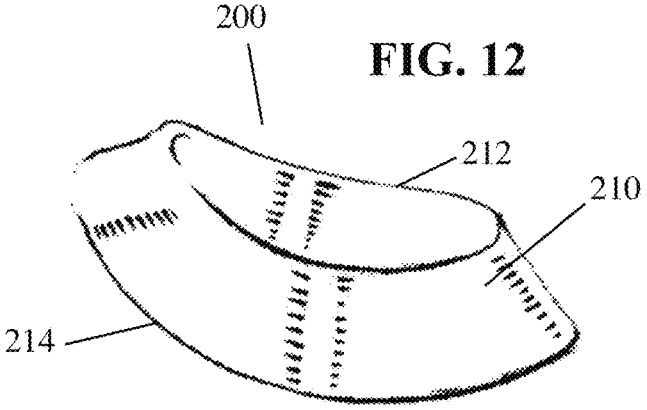
FIG. 12 is a perspective view of the restraining device of FIG. 8 having the hidden locking mechanism.

FIGS. 8-12 provides a second embodiment of the invention and concepts disclosed. As shown in FIG. 12, this embodiment may utilize a different tightening means than the prior embodiment, as it does not have a tightening means external to the top portion 212 of the ring-shaped member 200. Instead, unlike the pull-string 120 of FIGS. 1-7, this embodiment may keep the tightening means enclosed in the ring-shaped member 210 of the restraining device 200. Numerous means of tightening the top portion 212 around the foot/ankle/lower leg of the wearer may be utilized in this embodiment, including the pull-string from the prior embodiment. For example, a chord may be placed inside the top portion 212 and connect to the locking mechanism 230, such that the chord is not visible in the restraining device 200. Another example is the fourth embodiment depicted in FIG. 15. In another embodiment, a tightening means of bunching the material at the top portion 212 of the ring-shaped member 200 may similarly inhibit the removal of the footwear 20.

As shown in FIGS. 10-12, the locking mechanism 230 and tightening means may be hidden and not visible when attached to the footwear 20. The general concepts disclosed in the first embodiment of tightening the top portion 212 of the ring-shaped member 210 to inhibit the removal of the footwear 20 is generally the same for this second embodiment. As in the first embodiment, the ring-shaped member 210 of the restraining device 200 is placed over the collar 25 and tongue 24 of the footwear 20 and attaches to the footwear 20 at preferably the upper 21 of the footwear 20. Alternatively, the restraining device 200 may attach at the lower 22 of the footwear 20 or at any other portion of the footwear 20.

Once the wearer inserts their foot into the footwear 20 through the restraining device 200, the top portion 212 is tightened using the tightening means and locked into place using the locking mechanism 230. Thus, just as with the first embodiment, the restraining device 200 inhibits the removal of the footwear 20 regardless of whether the fastening means 23 of the footwear 20 are fastened. However, in this embodiment, the tightening means are hidden inside the top portion 212 of the ring-shaped member 210 and inside the locking mechanism 230, such that the tightening means are not visible.

Furthermore, the locking mechanism 230 may also be hidden underneath or behind the ring-shaped member 210, as shown in FIGS. 10-11, such that the wearer does not see the locking mechanism 230 while the restraining device 200 is attached to the footwear 20. This is particularly effective at inhibiting particular groups of wearers, such as children or adults with special needs, from locating and unlocking the locking mechanism 230. In this embodiment, a caretaker of this group of wearers may still access the locking mechanism 230 while locking the restraining device 200, then cover the locking mechanism 230 with the ring-shaped member 210, thereby concealing the locking member 230. FIGS. 10-12 display this embodiment of the restraining device 200, where the ring-shaped member 210 is covering the locking mechanism 230 such that it is inaccessible to the previously discussed group of wearers.

FIGS. 13-14 depict a third embodiment of the restraining device 300 secured to an article of footwear 30. FIG. 13 depicts the third embodiment in an unlocked configuration, while FIG. 14 depicts the third embodiment in a locked configuration. In general, the third embodiment of the restraining device 300 includes a restraining strap 310 and a locking mechanism 500. Optionally, the third embodiment may also include a comfort pad 312. For ease of reference, the footwear 30 in this third embodiment includes an upper 31, a lower 32, a fastening means 33, and a tongue 34.

In this third embodiment, the restraining strap 310 is preferably removably attached to the footwear 30. To attach the restraining strap 310 to the footwear 30, two openings are included in the fabric of the inside of the upper 31 on each side of the footwear 30, thereby creating an entry and exit for the restraining strap 310. Two apertures may also be made in the footwear tongue 34, forming one opening on each side of the footwear tongue 34. This creates two open passages through the footwear tongue 34, one on the left side of the footwear tongue 34 and the other on the right side of the footwear tongue 34, through which the restraining strap 310 passes.

Thus, as shown in FIG. 13, when the restraining device is in its unlocked position, the ends of the restraining strap 310 will exit through the front of the footwear tongue 34 and be configured to accept the locking mechanism 500. Prior to the locking mechanism 500 being locked, the restraining strap 310 is in a loose configuration, such that the restraining strap 310 is not inhibiting the removal of the footwear 30.

As shown in FIG. 14, once the locking mechanism 500 is placed onto the footwear 30 and locked in place, the restraining strap 310 can be locked around the wearer's foot, ankle, or lower leg, thereby inhibiting the removal of the footwear 30, even if the fastening means 33 is loosened or undone. Thus, when the restraining device 300 is in its unlocked position, the footwear 30 may be put on and taken off as with any footwear 30. Yet, when the restraining device 300 is in its locked position, the footwear 30 may not be put on or taken off, even if the footwear's fastening means 33 is loosened.

In this third embodiment, the concepts disclosed are configured to permit the locking mechanism 500 to be placed on the front of the footwear 30, specifically contacting the footwear tongue 34, as depicted in FIGS. 13-14. The restraining straps 310 are thus placed on the inside of the footwear 30 such that the restraining device 300 and footwear 30 are not detached from each other. In these embodiments, the use of a comfort pad 312 attached to the restraining strap 310 at the heel of the footwear 30 is preferable, especially if the material of the restraining strap 310 is uncomfortable. The inclusion of the comfort pad 312 provides comfort to the wearer's heel and achilleas tendon while wearing the footwear 30 having the restraining device 300. Further, the comfort pad 312 may further prevent any damage, such as blisters that may occur due to the tight fit of the restraining device 300 around the wearer's foot/ankle/lower leg. In some embodiments, the comfort pad 312 may not be necessary, especially should the material of the restraining strap 310 provide sufficient comfort to the wearer.

The restraining strap 310 may be manufactured of any suitable material. For example, the restraining strap 310 may be manufactured out of nylon, polyester, rubber, cotton, leather, neoprene, or other synthetic rubbers, fabrics, or elastics. Preferably, the restraining strap 310 will be manufactured out of a non-elastic material, such as leather. However, elastic compounds may be used as well so long as their elasticity is not so great that the restraining strap 310 is unable to inhibit the removal of the footwear 30 when the restraining device 300 is in a locked configuration. The comfort pad 312 may be manufactured out of any comfortable material, such as cotton, polyester, foam, memory foam, or similar compounds. Any material that provides greater comfort on the heel and achilleas of the wearer than the material used for the restraining strap 310 may be utilized for the comfort pad 312.

Figure 15:
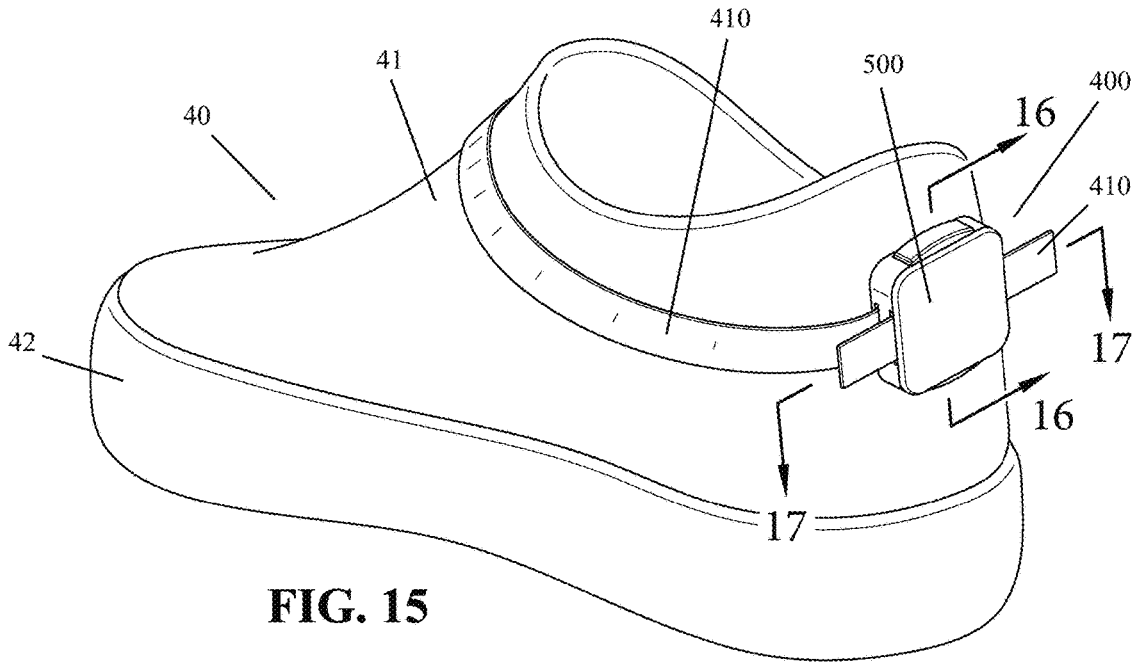
FIG. 15 is a rear perspective view of a fourth embodiment of a restraining device for inhibiting the removal of footwear secured to footwear.

FIG. 15 depicts the fourth embodiment of the restraining device 400 attached to an article of footwear 40. In this embodiment, the configuration of the restraining device 400 and the footwear 40 is very similar to the third embodiment, except the locking mechanism 500 is configured to be placed on the back of the footwear 40. In this fourth embodiment, the footwear includes an upper 41 and a lower 42. While this slip-on style of footwear is depicted for this embodiment, any suitable footwear may be utilized.

The restraining device 400 includes a restraining strap 410 and a locking mechanism 500. In this embodiment, the restraining strap 410 is configured to wrap around the top portion of the upper 41, with the locking mechanism 500 on the heel of the upper 41. As with the previous embodiments, the restraining device 400 may be configured to be removably attached to the footwear 40 or may be permanently attached as part of the footwear 40. In this embodiment, as well as the third embodiment, the unique structure of the locking mechanism 500 accompanied by the restraining strap 410 provides locking capabilities such that the restraining device 400 will inhibit the removal of the footwear 40 and the locking mechanism 500 will be difficult for particular groups of wearers to unlock.

Figure 16:
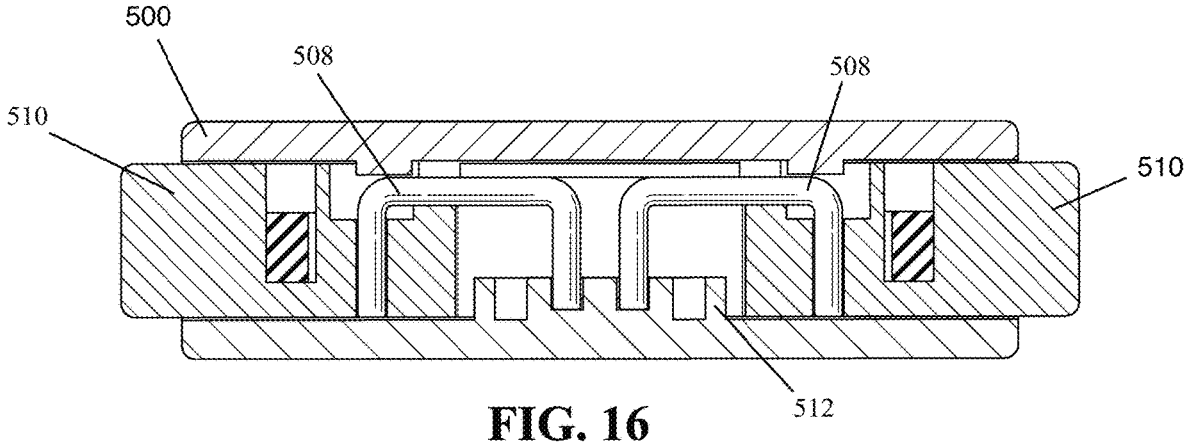
FIG. 16 is a vertical cross-section of the locking mechanism of the restraining device of FIG. 15.
Figure 17:
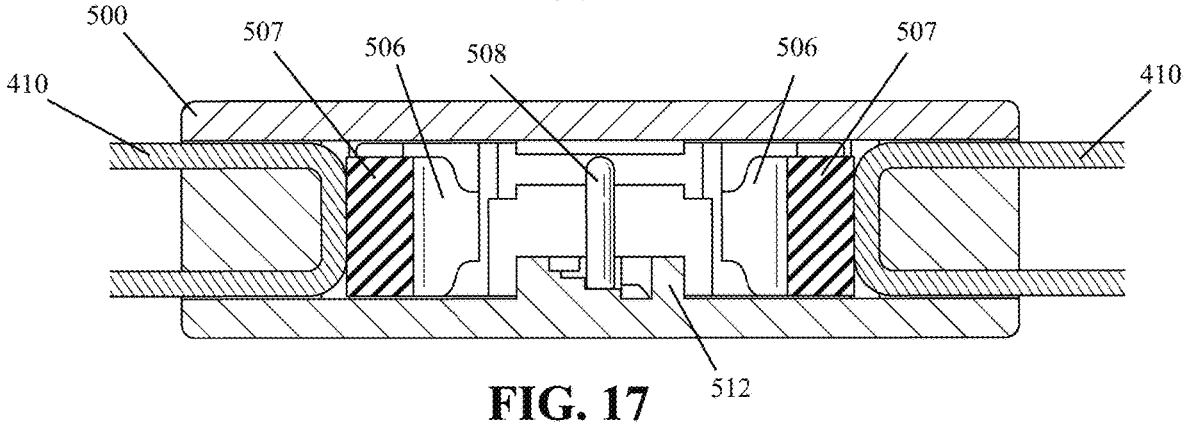
FIG. 17 is a horizontal cross-section of the locking mechanism of the restraining device of FIG. 15.
Figure 18:
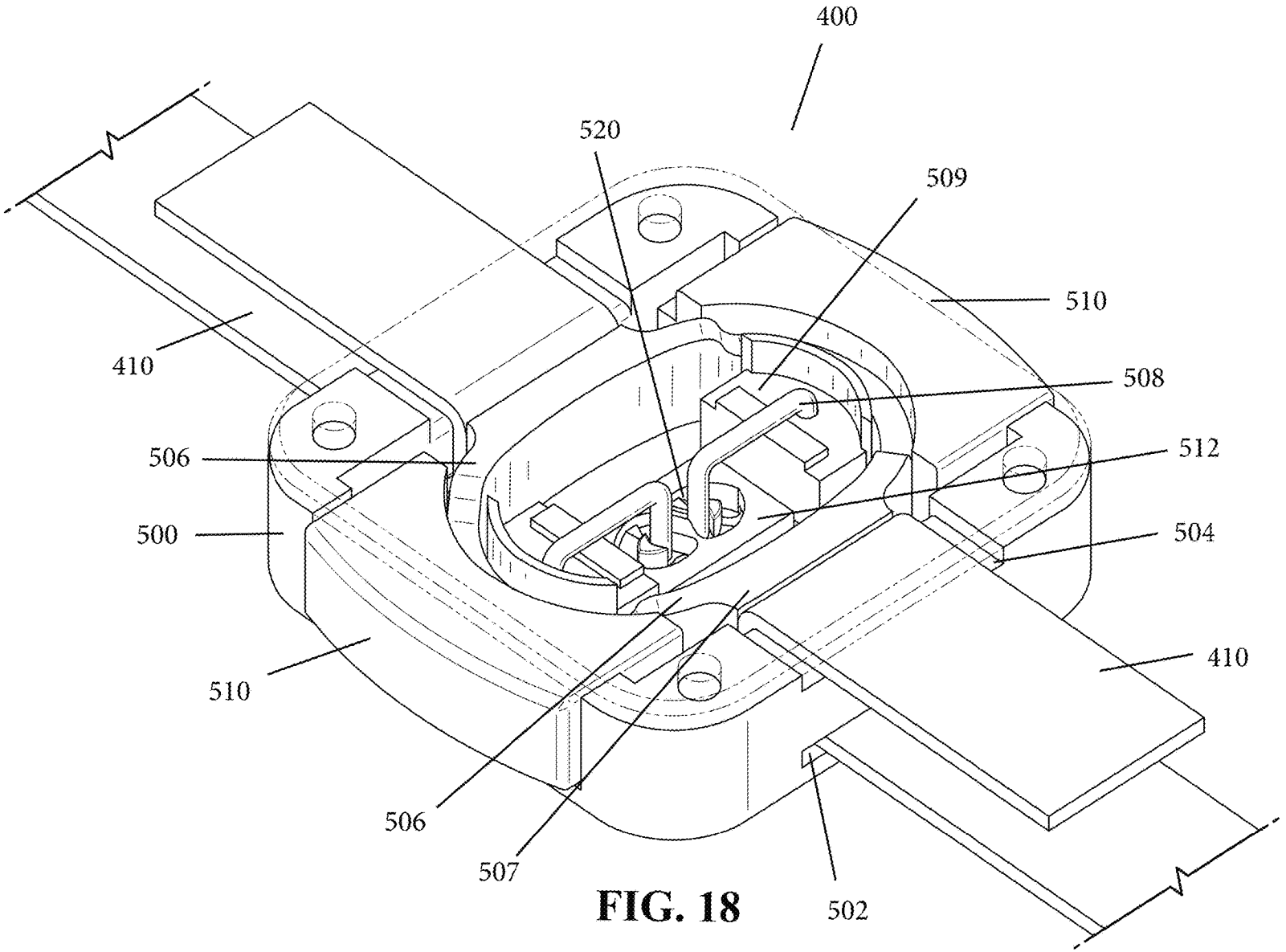
FIG. 18 is a perspective view of the internal mechanisms of the locking mechanism of the restraining device of FIG. 15.

FIGS. 16-22 depict the unique structure of the locking mechanism 500 used for the third and fourth exemplary embodiments. As shown in FIGS. 16-18, the locking mechanism 500 includes a strap insert slot 502, a strap exit slot 504, a flexible retainer 506 which may include a retainer block 507, two pins 508, a pin holder 509 for each pin 508, a push mechanism 510, and a locking plate 512. Each of these components are housed inside the locking mechanism 500 such that only the restraining straps 410 and the push-end of the push mechanism 510 are viewable, as depicted in FIGS. 13-15.

Inside the locking mechanism 500 is the flexible retainer 506. The flexible retainer 506 is configured to be of a flexible material, such that the flexible retainer 506 may be pushed and pulled into ovals of different shape. Abutting the outside of the two vertexes of the flexible retainer 506 are each push mechanism 510. The push mechanisms 510 are configured to be slightly convex on the side outside of the locking mechanism 500 and are concave on the inside of the locking mechanism 500 such that the outside of the ends of the flexible retainer 506 sit securely within concave section of the push mechanism 510. Abutting the outside of the two co-vertexes of the flexible retainer 506 are the retainer blocks 507. The retainer blocks 507 are configured to contact the restraining straps 410 when the locking mechanism 500 is in its locked configuration, while not contacting the restraining straps 410 when the locking mechanism 500 is in its unlocked configuration. In alternative embodiments, the retainer blocks 507 may not be utilized, in which case the flexible retainer 506 will instead be configured to interact with the restraining straps 410.

On the inside of the flexible retainer 506 sit the pins 508, the pin holders 509, and the locking plate 512. On the inside of the two vertexes of the flexible retainer 506 are the two pin holders 509, each at one vertex of the flexible retainer 506. In some embodiments, the pin holders 509 are constructed as a single piece with the flexible retainer 510. In other embodiments, the pin holders 509 are attached to the flexible retainer 506. In other embodiments, such as the embodiment depicted by FIG. 16, the pin holders 509 are constructed as a single piece with the push mechanism 510. In these embodiments, a slot will be positioned between the push mechanism 510 and the pin holders 509, the slot configured such that the flexible retainer 506 sits in the slot of the push mechanism 510 and pin holders 509. In each of these embodiments, pushing the push mechanism 510 causes the flexible retainer 506 to push the pin holder 509, thereby moving the pins 508 inside the locking plate 512.

Located in between the two pin holders 509 is the locking plate 512. The locking plate 512, depicted on its own in FIG. 21, includes two inset areas 520 that are generally heart shaped. As shown in FIGS. 16 and 18, the pins 508 are generally in an upside-down "U-shape," similar to the shape of a staple. Each pin 508 is configured to have one end placed in its respective pin holder 510, while the other end of each pin 508 sits within the inset area 520 of the locking plate 512. To function, the end of the pin 508 placed in the pin holder 509 may be capable of rotating, such that the end of the pin 508 inside the inset area 520 is able to shift side-to-side.

Figure 19:
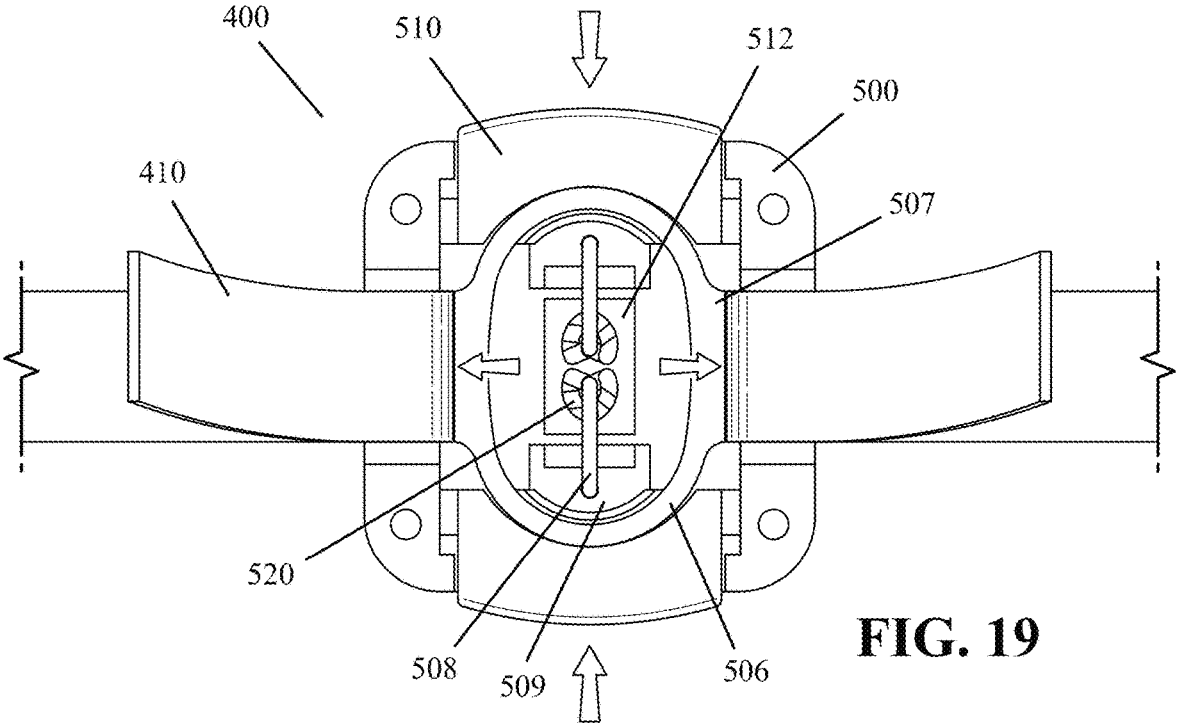
FIG. 19 is a top view of the internal mechanisms of the locking mechanism of the restraining device of FIG. 15 in a locked configuration.
Figure 20:
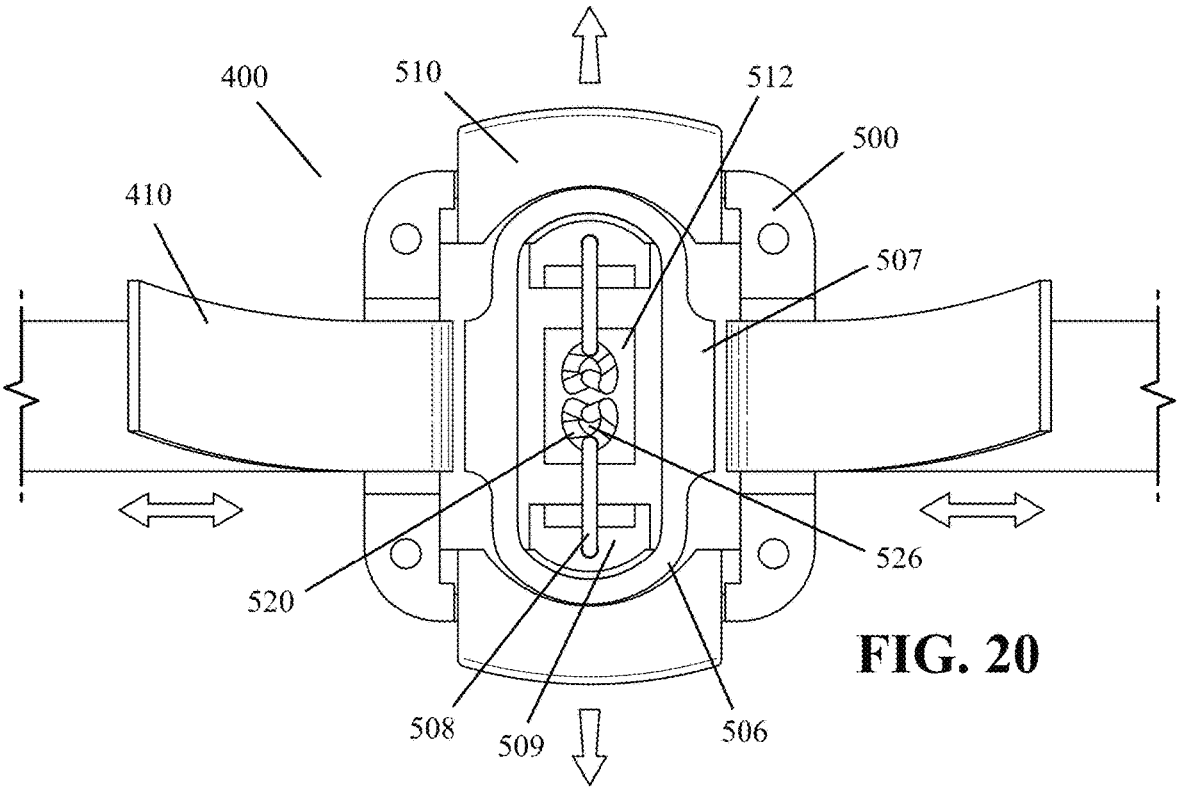
FIG. 20 is a top view of the internal mechanisms of the locking mechanism of the restraining device of FIG. 15 in an unlocked configuration.

FIGS. 19-20 depict the functionality of the locking mechanism 500. FIG. 19 depicts the locking mechanism 500 in its locked configuration, while FIG. 20 depicts the locking mechanism 500 in its unlocked configuration. While in the unlocked position, each end of the restraining strap 410 is inserted into the locking mechanism 500 through each strap insert slot 502 and exit the locking mechanism 500 through each strap exit slot 504. Thus, when the locking mechanism 500 is in its unlocked configuration, the restraining straps 410 may be freely pulled in and out of the locking mechanism 500, thereby tightening and loosening the restraining device 500. When the locking mechanism 500 is in its locked configuration, the restraining straps 410 are locked in place in the locking mechanism 500, thereby inhibiting the removal of the footwear 40 to which the restraining device 400 is attached.

Preferably, the flexible retainer 506 will be configured to be in its unlocked shape shown in the unlocked configuration of FIG. 20 when at rest. As such, the vertexes of the flexible retainer 506 will always be in contact with the push mechanisms 510. The push mechanisms 510 preferably have an edge configured to prevent the push mechanism 510 from being fully pushed out of the locking mechanism 500, such that in the unlocked configuration, the convex end and a portion of the push mechanism 510 are outside the locking mechanism 500. In the unlocked configuration, the flexible retainer 506 (and retainer block 507 if utilized) will not be in contact with the restraining strap 410. In the locked configuration, the flexible retainer 506 (and retainer block 507 if utilized) will be pressed against the restraining strap 410 with sufficient force to prevent the restraining strap 410 from being loosened or tightened.

The locking and unlocking of the locking mechanism 500 are initiated by pushing the push mechanism 510. As shown in FIG. 20, when the locking mechanism 500 is in its unlocked configuration, the pins 508 are positioned in the base level 521 of the locking plate 512. Locking the locking mechanism 500, as shown in FIG. 19, is caused by pushing in on the push mechanisms 510, thereby causing the flexible retainer 506 to be squeezed from an ovular shape into a more circular shape. This in turn causes the vertexes of the flexible retainer 506 to push on the pin blocks 509, while simultaneously causing the co-vertexes of the flexible retainer 506 (or retainer block 507 if utilized) to push against the restraining straps 410. Pushing in the pin blocks 509 through the above process causes the pins 508 to shift between the base level 521 of the inset area 520 and the lock level 524 of the inset area 520. Once the pins 508 are pushed into the lock level 524 of the locking plate 512, the locking mechanism 500 is shifted into its locked configuration, as shown in FIG. 19. Thus, in this position, the pins 508 are locked into the lock levels 524 of the locking plate 512 such that the flexible retainer 506 (or retainer block 507 if utilized) is pushed against the restraining straps 410, thereby locking the restraining straps 410 in place.

To unlock the locking mechanism 500, the push mechanisms 510 are again pushed in, which in turn shifts the pins 508 from the lock level 524 of the inset area 520 back to the base level 521 of the inset area 520. This in turn allows the flexible retainer 506 to return to its more ovular shape, where the flexible retainer 506 (or retainer block 507 if utilized) is no longer contacting the restraining straps 410.

Figure 21:
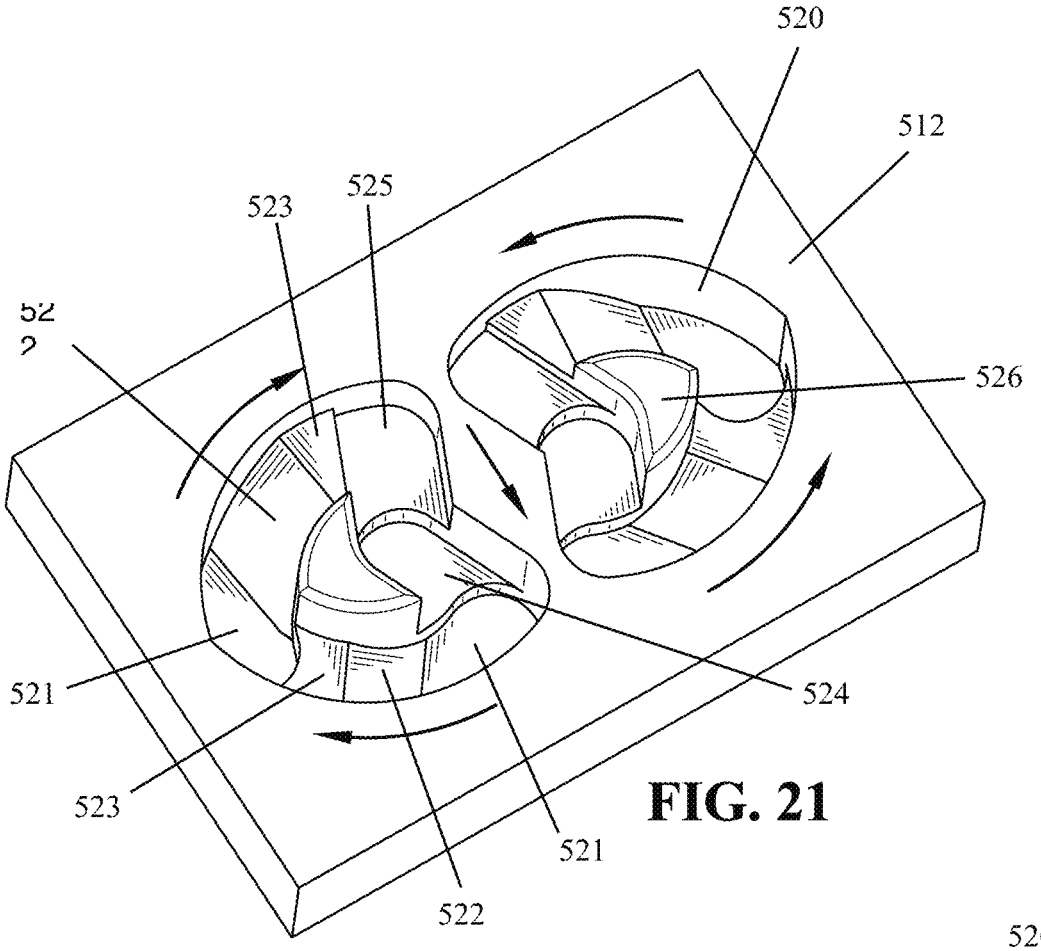
FIG. 21 is a perspective view of the locking plate of the locking mechanism of the restraining device of FIG. 15.
Figure 22:
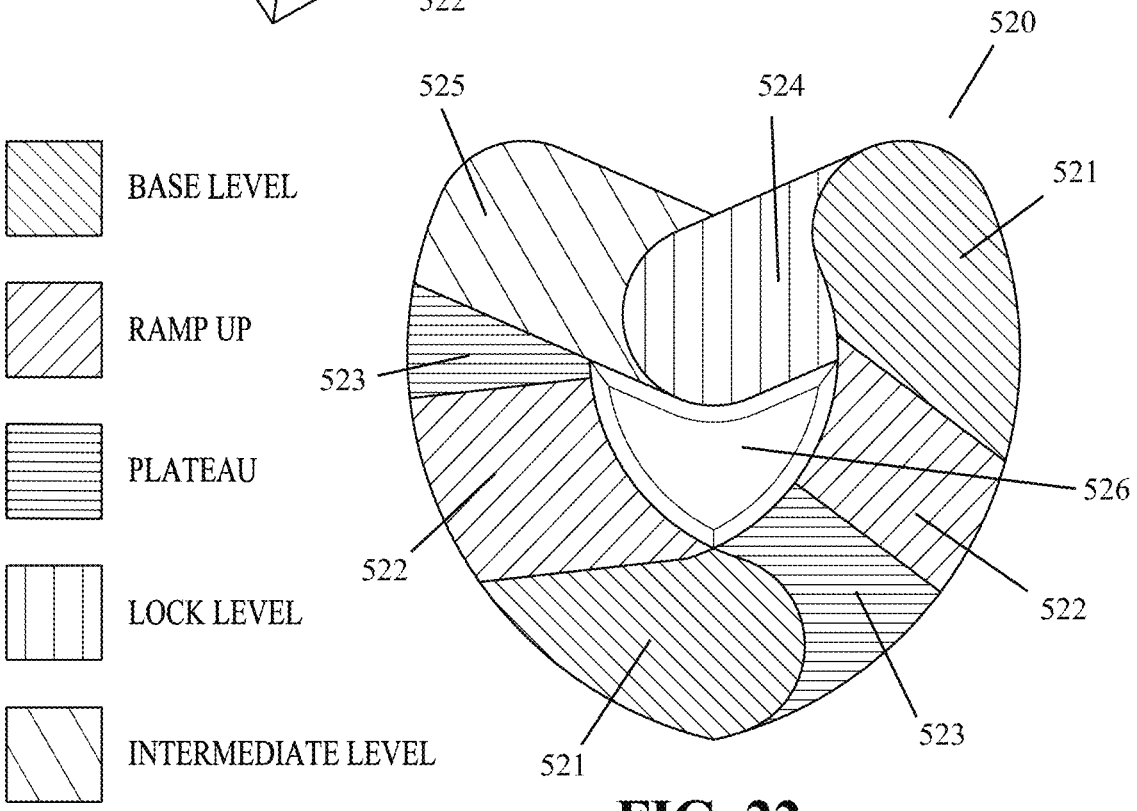
FIG. 22 is a top view of the inset area of the locking plate of the locking mechanism of the restraining device of FIG. 15.

FIGS. 21-22 depict the locking plate 512 and inset areas 520 of the locking plate 512. The unique configuration of the locking plate 512 and inset areas 520, accompanied by the pressure caused by the shape of the flexible retainer 506, allows the pins 508 to shift between the base level 521 and lock level 524, thereby locking and unlocking the locking mechanism 500. Each heart shaped inset area 520 of the locking plate 512 has at least one of the following five levels; a base level 521, a ramp up 522, a plateau 523, a lock level 524, and an intermediate level 525.

Starting in the unlocked position, the pin 508 will sit in the inset area 520 at the base level 521 closest to the pin holder 509. When the push mechanism 510 is pushed in, the pin 508 will be pushed from the base level 521 up the ramp up 522, past the plateau 523, and into the intermediate level 525. Due to the force of the flexible retainer 506 attempting to move back into its unlocked, more ovular shape, the pin 508 will automatically be pulled back towards the pin holder 509, which causes the pin to drop down to the lock level 524 of the inset area 520. Due to the concave shape of the center area 526 of the locking plate 512, the pin 508 will be locked into the lock level 524 and will be unable to exit the lock level 524 without external pressure on the push mechanism 510. Thus, the location of the pin 508 inside the lock level 524 of the inset area 520 accompanied by the pressure caused by the flexible retainer 506 attempting to return to its unlocked configuration will keep the locking mechanism 500 locked, in turn causing the restraining device 400 to inhibit the removal of the footwear 40 to which it is attached.

To return the locking mechanism 500 to its unlocked position, the push mechanism 510 is pressed to move the pin 508 inward out of the lock level 524 and into the second base level 521. Once the pin 508 is pushed into this base level 521, the force of the flexible retainer 506 trying to return to its unlocked configuration will force the pin 508 to move up the ramp up 522, past the plateau 523, and back into the first base level 521, back to its unlocked configuration. Thus, the unique interplay between the configuration of the inset area 520 of the locking plate 512 and the force caused by the flexible retainer 506 enable this locking mechanism 500 to lock and unlock the restraining device 400. While specific locking mechanisms have been described, one skilled in the art could substitute known locking mechanisms and remain within the scope of the invention to provide a footwear removal restraint.

Each of the discussed exemplary embodiments, as well as any other embodiments protected by the concepts disclosed herein, may be configured to be attached to any piece of footwear as a separate restraining device, or integrated into an article of footwear, such that the restraining device is part of the footwear. For example, the third embodiment depicted by FIG. 15 may be configured to be a part of the footwear 40 such that the restraining strap 410 and/or locking mechanism 500 cannot be removed from the footwear 40 or be configured to be removable from the footwear 40 such that the restraining device 400 can be attached to any article of footwear 40. Preferably, the restraining device is configured to be removably attachable to any article of footwear 10, 20, 30, 40.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

What is claimed is:

1. An article of footwear comprising:

an upper having an outer portion and an inner portion;

a lower;

a collar;

a tongue;

a fastening means; and a restraining device;

the restraining device comprising a restraining strap having a first end and a second end, and a locking mechanism configured to operate separately and independently from the fastening means;

wherein the first end and the second end of the restraining strap are each configured to be placed through the collar;

wherein the first end and the second end of the restraining strap are each configured to be placed through the locking mechanism, and wherein the locking mechanism is configured to lock the restraining strap in a locked configuration.

2. The article of footwear of claim 1, further comprising a comfort pad configured to be placed on the collar.

3. The article of footwear of claim 1, wherein the restraining device is configured to be removably attached to the article of footwear.

4. The article of footwear of claim 1, wherein said locking mechanism comprises a strap insert slot;

a strap exit slot;

a flexible retainer;

at least one pin;

a push mechanism; and a locking plate, wherein the locking plate includes a lock level and a base level;

wherein the at least one pin is configured to shift between the lock level and the base level of the locking plate, thereby shifting the locking mechanism between the locked configuration and an unlocked configuration;

wherein the restraining strap is configured to insert into the locking mechanism through the strap insert slot such that it exits the locking mechanism through the strap exit slot;

wherein the push mechanism configured to contact the flexible retainer;

wherein the flexible retainer configured to shift the at least one pin between the lock level and the base level of the locking plate; and wherein the flexible retainer configured to abut the restraining strap when the locking mechanism is in said locked configuration.

* * * * *